US007654880B2

(12) United States Patent
Schneider

(10) Patent No.: US 7,654,880 B2
(45) Date of Patent: Feb. 2, 2010

(54) FLICKER-TYPE FLYING TOY DEVICE

(75) Inventor: Paul W. Schneider, Oconomowoc, WI (US)

(73) Assignee: Ventura Services, Inc., Las Vegas, NV (US)

( * ) Notice: Subject to any disclaimer, the term of this patent is extended or adjusted under 35 U.S.C. 154(b) by 146 days.

(21) Appl. No.: 10/599,318

(22) PCT Filed: Mar. 25, 2005

(86) PCT No.: PCT/US2005/010072

§ 371 (c)(1),
(2), (4) Date: Sep. 25, 2006

(87) PCT Pub. No.: WO2005/097284

PCT Pub. Date: Oct. 20, 2005

(65) Prior Publication Data

US 2008/0242185 A1 Oct. 2, 2008

(51) Int. Cl.
*A63H 27/16* (2006.01)
*A63H 27/00* (2006.01)

(52) U.S. Cl. ..... 446/46; 446/62; 446/486

(58) Field of Classification Search ..... 446/46–48, 446/34, 61, 63–65, 487, 488, 486; 473/569, 473/590, 591
See application file for complete search history.

(56) References Cited

U.S. PATENT DOCUMENTS

| | | | | |
|---|---|---|---|---|
| D219,822 | S | 2/1971 | Rockaitis | |
| 4,265,454 | A | 5/1981 | Bayless | |
| D275,580 | S | 9/1984 | Bowen | |
| 5,338,027 | A | 8/1994 | Rehkemper | |
| 5,800,236 | A * | 9/1998 | Joun | 446/46 |

OTHER PUBLICATIONS

PCT/US2005/010072 International Search Report and Written Opinion dated Aug. 3, 2005.

* cited by examiner

*Primary Examiner*—Kien T Nguyen
(74) *Attorney, Agent, or Firm*—Boyle Fredrickson, S.C.

(57) ABSTRACT

A flying toy (10) includes a planar body defining an outer edge (16). A recess (18) extends inwardly from die outer edge and includes an undercut section (22). The body defines a hook section (24) adjacent the undercut section of the recess, and a finger engagement section (28) opposite the hook section that defines a pair of wings (32, 34). The wings are resilient, and include outer end areas that can be spread apart. The recess is configured to receive the tip of a user's finger. When the user's fingertip is positioned within the recess, the hook section engages one side of the user's finger and the finger engagement section engages an opposite side of the user's finger. The wings spread apart so as to stabilize the body on the user's finger. The user flicks his or her finger to dislodges the flying toy from the user's fingertip, and the flying toy is then propelled through the air.

14 Claims, 8 Drawing Sheets

FLICKER-TYPE FLYING TOY DEVICE

BACKGROUND AND SUMMARY OF THE INVENTION

This invention relates to games, toys and the like, and more particularly to a flying toy that is propelled by a manual force applied by a user.

In accordance with one aspect of the present invention, a flying toy, which is propelled by a user's finger, includes a generally planar body defining an outer edge. A recess extends inwardly from the outer edge of the body. The recess includes an undercut section, and the body is formed to define a hook section adjacent the undercut section of the recess. At a location adjacent the recess and opposite the hook section, the body includes a finger engagement section that defines a pair of wings. The wings are preferably resilient, and include outer end areas that are adapted to be spread apart. The recess is configured to receive the tip of a user's finger. When the user's fingertip is positioned within the recess, the hook section of the body engages one side of the user's finger and the finger engagement section of the body engages an opposite side of the user's finger. The wings of the finger engagement section spread apart so as to stabilize the body on the user's finger. The user then places his or her hand so that the user's palm faces upwardly, and curls the finger back toward the wrist, while maintaining the flying toy in engagement with the fingertip. The user then engages the thumb with his or her finger alongside the flying toy, and subsequently flicks his or her finger by quickly straightening the finger and disengaging the thumb from the finger. Such quick and rapid movement of the user's finger dislodges the flying toy from the user's fingertip, and the flying toy is then propelled through the air. The flying toy spins as it travels through the air, and the generally planar configuration of the body of the flying toy enables the flying toy to travel a significant distance.

The invention also contemplates a method of propelling a flying toy through the air, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
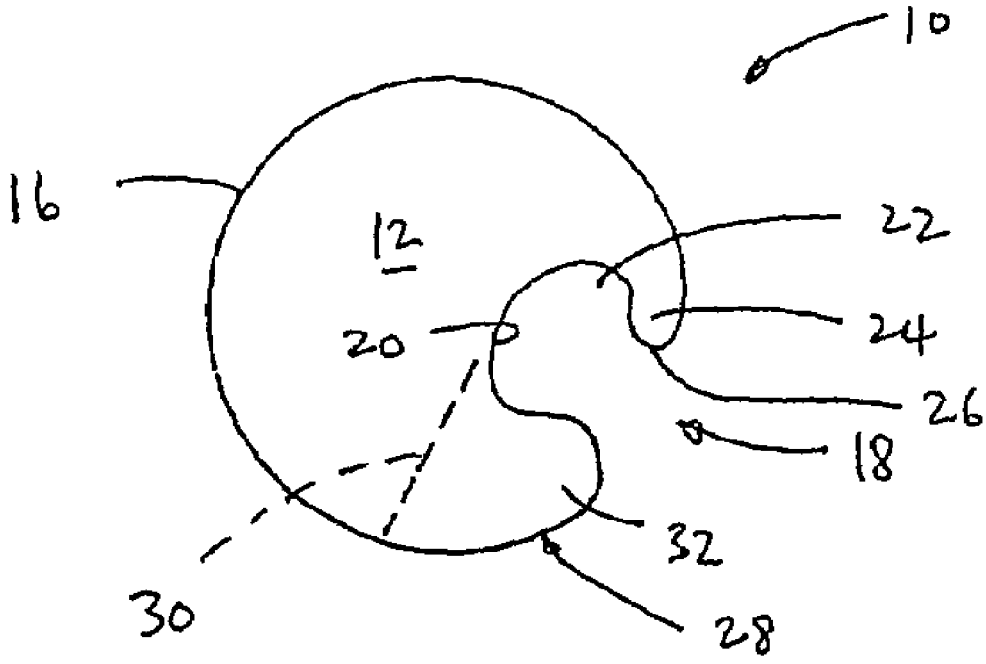
FIG. 1 is an elevation view of the flying toy device of the present invention.
Figure 2:
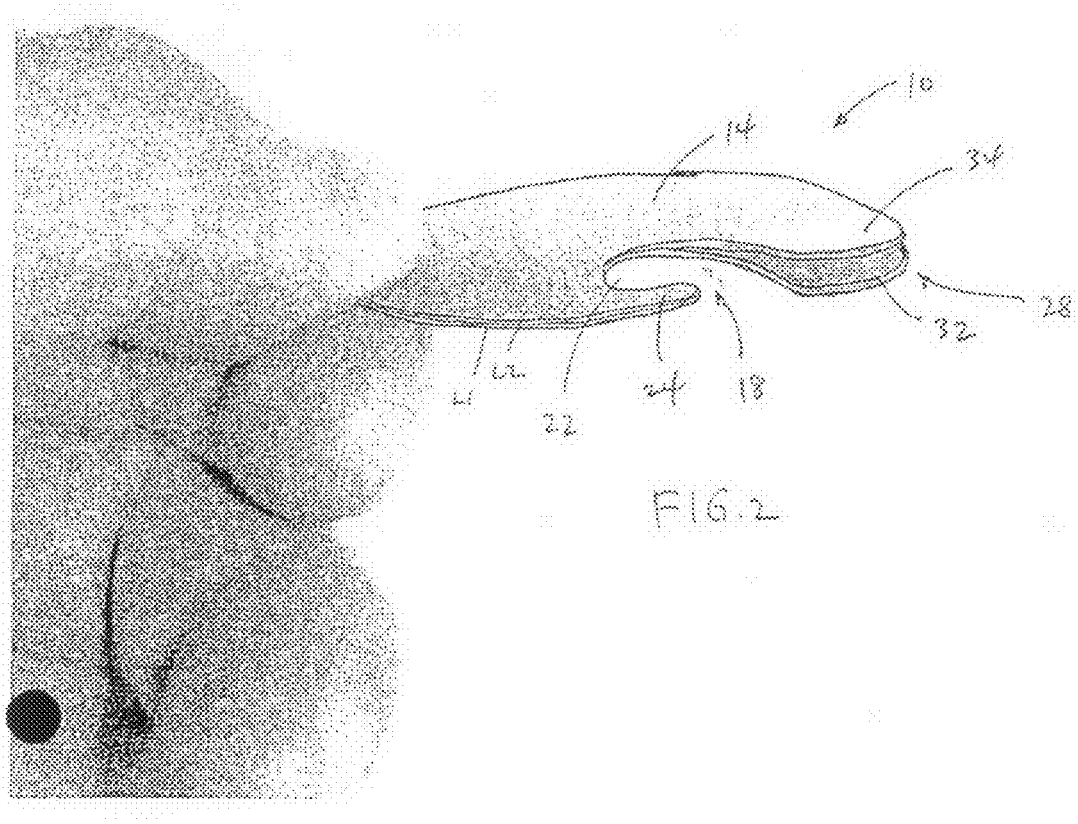
FIG. 2 is an isometric view showing the flying toy device of FIG. 1.
Figure 3:
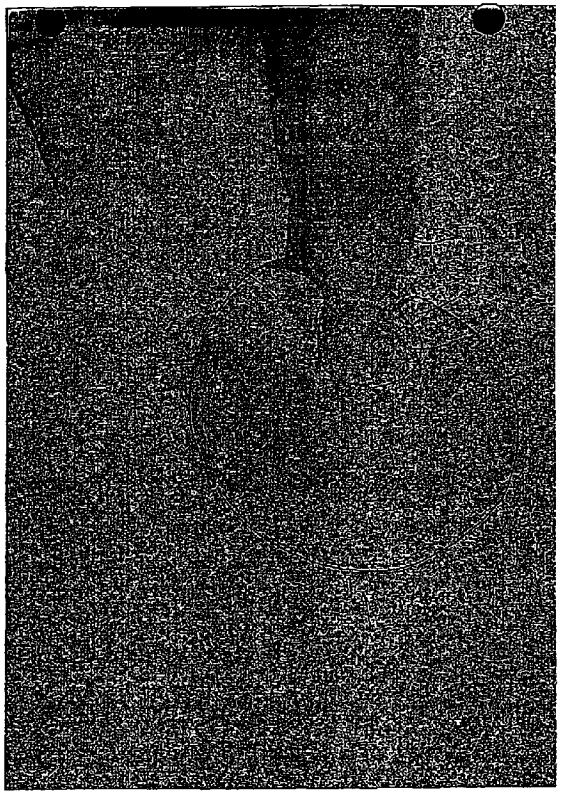
FIG. 3 is an elevation view of the flying toy device of FIG. 1 in engagement with the tip of a user's finger.
Figure 4:
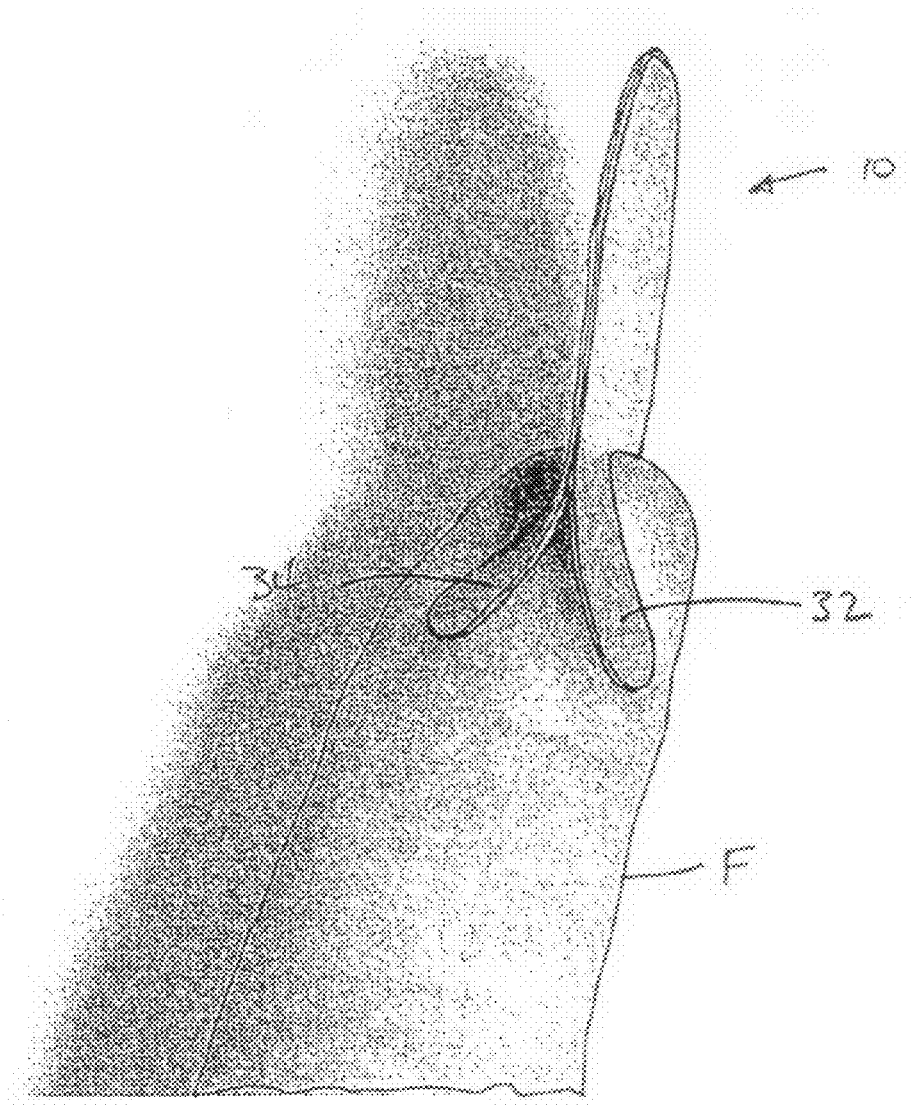
FIG. 4 is another isometric view of the flying toy device of FIG. 1, showing the flying toy device in engagement with the tip of a user's finger.
Figure 5:
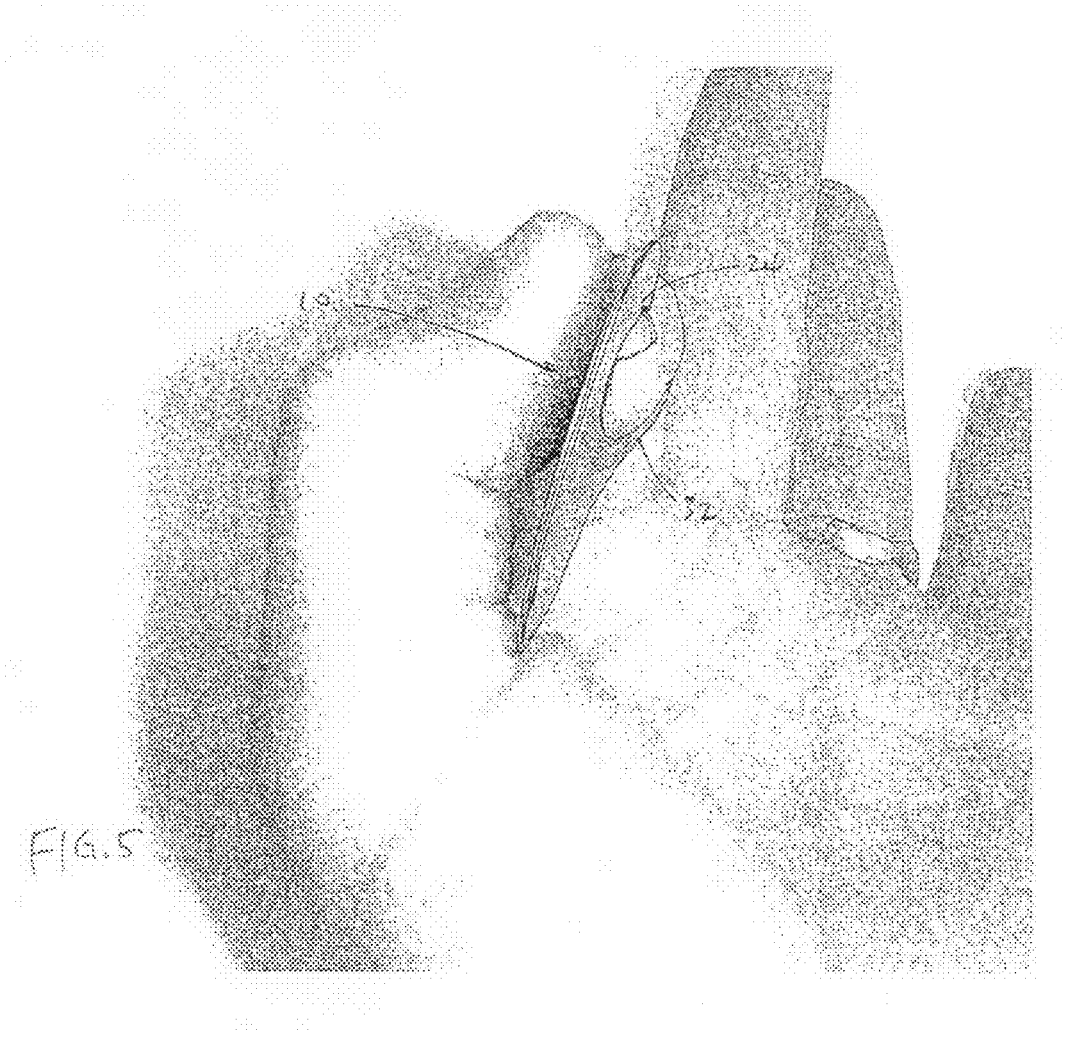
FIG. 5 is another isometric view of the flying toy device of FIG. 1, showing the flying toy device in engagement with the tip of a user's finger and the user's finger in a position ready to launch the flying toy device.

Referring to FIGS. 1-5, a flying toy or finger flicker device 10 in accordance with the present invention is in the form of a generally planar body have oppositely facing surfaces 12, 14 that define an outer edge 16. A specially configured recess 18 is formed in the body of device 10. Recess 18 is configured to receive the tip of a user's finger F, for use in propelling device 10 through the air.

Recess 18 includes an arcuate edge 20, and defines an undercut area 22 which functions to form a hook section 24 on the body of device 10 adjacent the entrance to recess 18. Hook section 24 terminates an end 26, which may have either a rounded or a pointed shape.

On the opposite side of recess 18 from hook section 24, the body of device 10 has a split finger engagement section 28, which is located forwardly of a boundary 30 that extends generally tangentially to the innermost extent of recess edge 20.

Split finger engagement section 28 has a cleft construction, defining a pair of wings 32, 34 located forwardly of boundary 30. Representatively, device 10 may be formed of a pair of layers L1 and L2 of resilient material that are laminated together throughout the entire surface area of the body of device 10, with the exception of the area of split finger engagement section 28. It is understood that this is but one possible construction of device 10, and that device 10 may be formed in any manner that defines a planar configuration throughout its surface area with the exception of split finger engagement section 28. Split finger engagement section 28 may be formed in any manner and joined to the remainder of the body of device 10. It is contemplated that the laminated construction of the body of device 10 as shown and described provides a relatively simple and inexpensive means for forming split finger engagement section 28, and which is well suited for mass production.

Wings 32, 34 are resilient and flexible, which enables wings 32, 34 to be spread apart and to then return at least partially together. Preferably wings 32, 34 are at all times positioned such that their facing surfaces are in engagement with each other, other than when a user's finger is positioned therebetween in a manner to be explained. Again, this feature is satisfactorily provided by the integral formation of wings 32, 34 with the remainder of the body of device 10. Representatively, the laminated layers L1 and L2 of the body of device 10 may be formed of any satisfactory resilient thermoplastic material, although it is understood that any other satisfactory material may be employed such as paperboard or the like.

In use, device 10 is adapted to be engaged with a user's finger F, which is used to propel device 10 through the air. To accomplish this, the user places the tip of his or her finger into recess 18, so that end 26 of hook section 24 engages the user's fingernail. Finger engagement section 28 engages the opposite surface of the user's fingertip. Wings 32, 34 of finger engagement section 28 are spread apart, so that wings 32, 34 engage opposite sides of the user's fingertip opposite hook section 24. With this arrangement, wings 32, 34 function to stabilize device 10 on the user's fingertip. The user then places his or her hand so that the user's palm faces upwardly, and curls the finger F back toward the wrist while maintaining device 10 in engagement with the fingertip. The user then engages the thumb with finger F alongside device 10, and subsequently flicks the finger F by quickly straightening finger F and disengaging the thumb from finger F. Such quick and rapid movement of finger F functions to dislodge device 10 from the tip of finger F, and device 10 is then propelled spinning through the air. The generally planar configuration of the majority of the surface area of device 10 enables device 10 to travel a significant distance through the air. The wings 32, 34 preferably return together when the device 10 is launched through the air, to minimize aerodynamic resistance. Alternatively, wings 32, 34 may be formed so as to remain apart, which affects the aerodynamic characteristics of device 10. In this arrangement, wings 32, 34 may be configured to provide a desired performance of device 10 when device 10 is propelled through the air.

Figure 6:
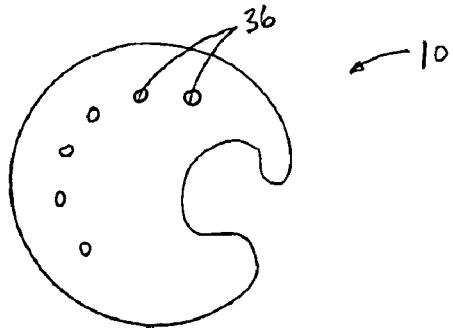
FIGS. 6 and 7 are views similar to FIG. 1, showing alternative embodiments of the flying toy device of the present invention.
Figure 7:
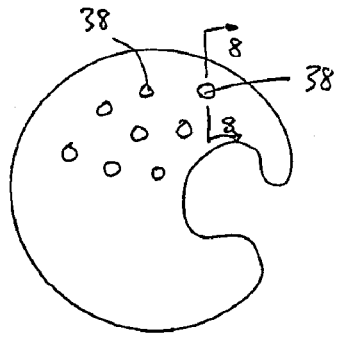
Figure 8:
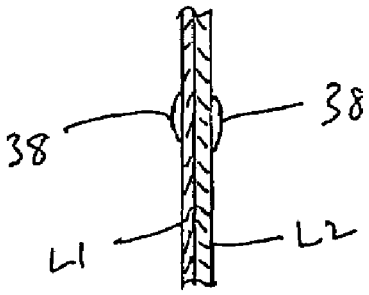
FIG. 8 is a partial section view taken along line 8-8 of FIG. 7.
Figure 9:
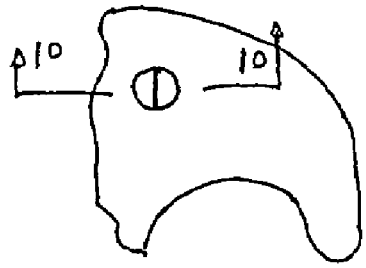
FIG. 9 is a partial plan view showing a portion of the flying toy device of the present invention with a surface adaptation to alter the aerodynamic characteristics of the flying toy device.
Figure 10:
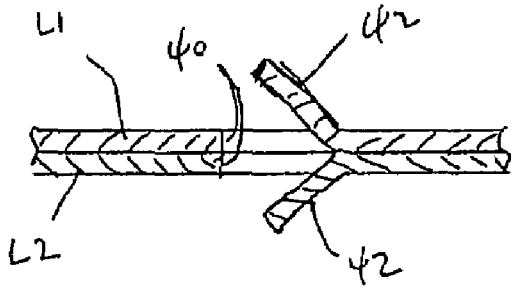
FIG. 10 is a partial section view taken along line 10-10 of FIG. 9.

FIG. 6 illustrates an alternative construction of device 10, which includes openings 36 that extend throughout the thickness of the body of device 10 between surfaces 12, 14. In the illustrated embodiment, openings 36 are arranged in an arcuate pattern, although it is understood that any other opening arrangement may be employed. Openings such as 36 affect the aerodynamic characteristics of device 10, to provide a desired performance of device 10 when device 10 is launched and spins through the air. FIGS. 7 and 8 illustrate other surface alterations that may be incorporated into the surfaces 12, 14 of device 10. In this embodiment, raised bumps or protrusions 38 may extend outwardly from one or both of surfaces 12, 14. Again, bumps or protrusions 38 affect the aerodynamic characteristics of device 10, to provide a desired performance of device 10 when device 10 is launched and spins through the air. FIGS. 9 and 10 show perforations 40 that are formed in one or both surfaces of device 10, which define flaps 42 that extend outwardly from the surface(s) of device 10 at each perforation 40. Flaps 42 affect the aerodynamic characteristics of device 10, to provide a desired performance of device 10 when device 10 is launched and spins through the air. In all cases, device 10 may be formed with any number of surface alterations such as openings 36, protrusions 38 or flaps 42, in any desired pattern. It is understood that illustrated surface alterations are representative, and that other surface alterations are possible and are contemplated as being within the scope of the present invention.

Figure 11:
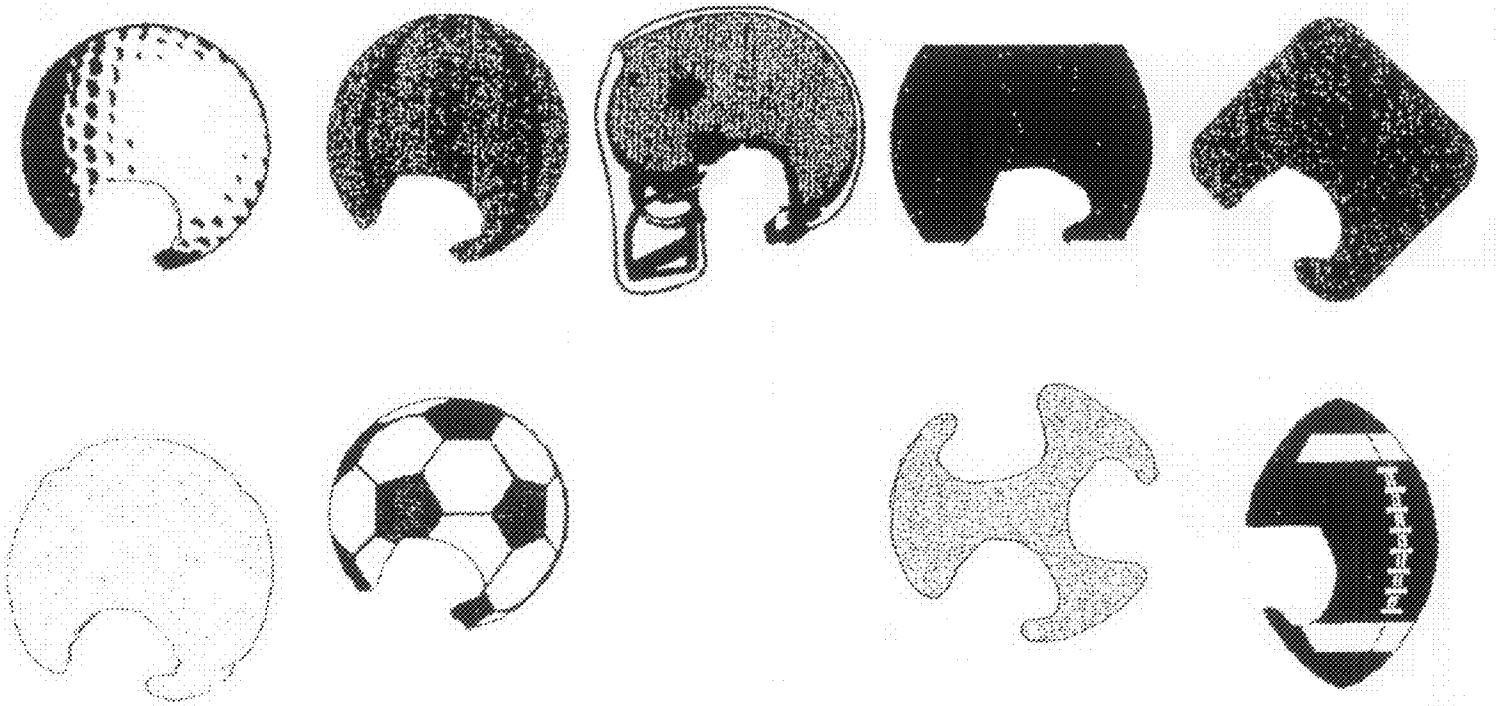
FIG. 11 is a view illustrating various configurations of the flying toy-device of the present invention.

As shown in FIG. 11, It is contemplated that the overall shape of device 10 may vary from that as shown. That is, the overall shape or silhouette of device 10 defined by outer edge 16 may take any form other than that as shown and described, e.g. a generally round shape, an oblong shape, etc. A round shape may be formed so that device 10 may represent the outline of a baseball, basketball, soccer ball, etc., with appropriate graphics applied to the opposite-surfaces 12, 14 of device 10. An oblong shape may be provided so that device 10 can resemble a football, again with appropriate graphics applied to the opposite surfaces 12, 14 of device 10. Any other satisfactory shape may be provided for the overall configuration of device 10, and representative shapes of device 10 are illustrated. In all configurations, however, device 10 includes recess 18 that defines hook section 24, as well as split finger engagement section 28 so as to facilitate engagement of device 10 with the user's fingertip.

It can thus be appreciated that opposite surfaces 12, 14 of device 10 present surfaces that are well suited for application of graphics or printed information, so that device 10 may be used as a vehicle for promotion or advertising.

Various alternatives and embodiments are contemplated as being within the scope of the following claims particularly pointing out and distinctly claiming the subject matter regarded as the invention.

I claim:

1. A device adapted to be propelled by a finger of a user, comprising:

a generally planar body defining an outer edge;

a recess formed in the outer edge, wherein the recess includes an undercut section and wherein the body is formed so as to define a hook section adjacent the undercut section of the recess; and wherein a portion of the body adjacent the recess, opposite the hook section, comprises a finger engagement section defining a pair of wings, wherein the wings are capable of being spread apart;

wherein the tip of a user's finger is engageable within the recess, wherein the hook section of the body engages one side of the user's finger and wherein the finger engagement section of the body engages an opposite side of the user's finger, wherein the wings of the finger engagement section are adapted to be spread apart so as to stabilize the body on the user's finger, wherein the wings are resilient and are biased toward each other, wherein the resiliency of the wings enables the wings to grip the user's finger.

2. The device of claim 1, wherein the body is formed of a pair of layers that are secured together except in the area of the finger engagement section, wherein the layers of the finger engagement section define the pair of wings.

3. The device of claim 2, wherein the pair of layers define facing surfaces that are adhered together other than in the area of the finger engagement section.

4. A device adapted to be propelled by a finger of a user, comprising:

a generally planar body defining an outer edge;

a recess formed in the outer edge. wherein the recess includes an undercut section and wherein the body is formed so as to define a hook section adjacent the undercut section of the recess; and wherein a portion of the body adjacent the recess, opposite the hook section. comprises a finger engagement section defining a pair of wings, wherein the wings are capable of being spread apart;

wherein the tip of a user's finger is engageable within the recess, wherein the hook section of the body engages one side of the user's finger and wherein the finger engagement section of the body engages an opposite side of the user's finger, wherein the wings of the finger engagement section are adapted to be spread apart so as to stabilize the body on the user's finger, and wherein the recess and the finger engagement section are spaced apart from each other and define an opening though which the fingertip of a user is inserted into the recess.

5. The device of claim 4, wherein the hook section defines an outermost extent of the undercut section of the recess.

6. The device of claim 4 further comprising aerodynamic structure associated with oppositely facing surfaces defined by the body for altering the movement of the device when the device is launched by a user so as to spin though the air.

7. A flying toy device adapted to be propelled by a finger of a user, comprising:

a generally planar body defining first and second oppositely facing sides and an outer edge;

a recess extending inwardly from the outer edge, wherein the recess defines an entryway and wherein the body defines first and second spaced apart finger engagement areas on opposite sides of the entryway;

wherein the recess is configured to define an enlarged area inwardly of the first finger engagement section; and wherein the second finger engagement section includes laterally spaced apart finger engagement structure, wherein the laterally spaced apart finger engagement structure comprises a pair of laterally spaced apart finger engagement members that define a space therebetween that is configured to receive a portion of the user's finger;

wherein the tip of a user's finger is engageable within the recess through the entryway to the recess, wherein the first finger engagement section engages one side of the user's finger and wherein the second finger engagement section engages an opposite side of the user's finger, wherein the laterally spaced apart finger engagement members of the second finger engagement section engage the user's finger at spaced locations wherein the user's finger is received within the space between the finger engagement members, to stabilize the flying toy device on the user's finger.

8. The flying toy device of claim 7, wherein the first finger engagement section includes an end area that extends past the enlarged area of the recess and terminates in an end that is configured to engage one side of the user's finger.

9. The flying toy device of claim 8, wherein the recess defines an arcuate inner edge that extends between the second finger engagement section and the end area of the first finger engagement section.

10. A flying toy device adapted to be propelled by a finger of a user, comprising:

a generally planar body defining first and second oppositely facing sides and an outer edge;

a recess extending inwardly from the outer edge. wherein the recess defines an entryway and wherein the body defines first and second spaced apart finger engagement areas on opposite sides of the entryway, wherein the first finger engagement section includes an end area that extends past the enlarged area of the recess and terminates in an end that is configured to engage one side of the user's finger;

wherein the recess is configured to define an enlarged area inwardly of the first finger engagement section; and wherein the second finger engagement section includes laterally spaced apart finger engagement structure, wherein the laterally spaced apart finger engagement structure comprises a pair of wing members;

wherein the tip of a user's finger is engageable within the recess through the entryway to the recess, wherein the first finger engagement section engages one side of the user's finger and wherein the second finger engagement section engages an opposite side of the user's finger, wherein the laterally spaced apart finger engagement structure of the second finger engagement section engages the user's finger at spaced locations to stabilize the flying toy device on the user's finger.

11. The flying toy device of claim 10, wherein the wing members are resilient and are biased toward each other to a closed position, wherein the wing members pinch together onto a user's finger when the user's finger is positioned within the recess.

12. The flying toy device of claim 11, wherein the body comprises a pair of layers that are adhered together other than in the area of the second finger engagement section to define the pair of wing members.

13. A method of propelling a flying toy device by a user, comprising the acts of:

providing a generally planar body defining first and second oppositely facing sides and an outer edge; a recess extending inwardly from the outer edge, wherein the recess defines an entryway and wherein the body defines first and second spaced apart finger engagement areas on opposite sides of the entryway, wherein the recess is configured to define an enlarged area inwardly of the first finger engagement section; and wherein the second finger engagement section includes laterally spaced apart finger engagement structure;

inserting the tip of the user's finger into the recess through the entryway to the recess, wherein the first finger engagement section engages one side of the user's finger and wherein the second finger engagement section engages an opposite side of the user's finger;

engaging the laterally spaced apart finger engagement structure of the second finger engagement section with the user's finger at spaced locations to stabilize the flying toy device on the user's finger;

engaging the user's finger with the user's thumb alongside the flying toy, and subsequently flicking the user's finger by straightening the finger and disengaging the thumb from the finger, to dislodge the flying toy device from the user's finger, to propel the flying toy in a spinning manner through the air.

14. The method of claim 13, wherein the laterally spaced apart finger engagement structure comprises a pair of wing members, wherein the wing members are resilient and are biased toward each other to a closed position, and wherein the act of engaging the laterally spaced apart finger engagement structure with the user's finger is carried out by pinching the user's finger between the pair of wing members by the resiliency of the wing members when the user's finger is positioned within the recess.

* * * * *

UNITED STATES PATENT AND TRADEMARK OFFICE

CERTIFICATE OF CORRECTION

PATENT NO. : 7,654,880 B2
APPLICATION NO. : 10/599318
DATED : February 2, 2010
INVENTOR(S) : Paul W. Schneider It is certified that error appears in the above-identified patent and that said Letters Patent is hereby corrected as shown below:

IN THE CLAIMS

CLAIM 4, column 4, line 53, delete "though" and substitute therefore -- through --;

CLAIM 6, column 4, line 60, delete "though" and substitute therefore -- through --.

Signed and Sealed this

Eleventh Day of May, 2010

David J. Kappos

David J. Kappos
*Director of the United States Patent and Trademark Office*